US010844692B1

(12) United States Patent
Griffin et al.

(10) Patent No.: US 10,844,692 B1
(45) Date of Patent: Nov. 24, 2020

(54) SUBSURFACE WELLBORE WIPER DEPLOYMENT SYSTEM AND METHOD OF USE

(71) Applicants: Tim Griffin, Tuttle, OK (US); Henry E. Rogers, Collinsville, OK (US); Gary Joe Makowiecki, Spring, TX (US)

(72) Inventors: Tim Griffin, Tuttle, OK (US); Henry E. Rogers, Collinsville, OK (US); Gary Joe Makowiecki, Spring, TX (US)

( * ) Notice: Subject to any disclaimer, the term of this patent is extended or adjusted under 35 U.S.C. 154(b) by 90 days.

(21) Appl. No.: 16/289,879

(22) Filed: Mar. 1, 2019

(51) Int. Cl.
*E21B 33/16* (2006.01)
*E21B 37/10* (2006.01)
*E21B 37/02* (2006.01)
*E21B 33/08* (2006.01)

(52) U.S. Cl.
CPC ..... *E21B 37/02* (2013.01); *E21B 33/08* (2013.01)

(58) Field of Classification Search
CPC ..... E21B 33/16; E21B 33/165; E21B 33/167; E21B 37/10; E21B 37/045; E21B 37/04; B08B 9/04
See application file for complete search history.

(56) References Cited

U.S. PATENT DOCUMENTS

| | | | | |
|---|---|---|---|---|
| 8,887,807 | B2 * | 11/2014 | Gambier | E21B 33/16 166/291 |
| 9,085,952 | B2 * | 7/2015 | Rondeau | E21B 33/05 |
| 2014/0116732 | A1 * | 5/2014 | Acosta | E21B 43/12 166/387 |
| 2018/0023362 | A1 * | 1/2018 | Makowiecki | E21B 34/14 166/374 |
| 2019/0017348 | A1 * | 1/2019 | Nanney | E21B 33/14 |

* cited by examiner

*Primary Examiner* — Kipp C Wallace

(57) ABSTRACT

A subsurface wellbore wiper deployment system includes a plug having an elongated body with an exterior surface; one or more exposed wipers extending away from the exterior surface; and one or more hidden wipers secured to the exterior surface and positioned underneath a removable sleeve; and a landing collar having a landing seat extending into an interior of the landing collar; the removable sleeve is to engage with the landing seat upon deployment of the plug; and the landing collar removes the removable sleeve to expose the one or more hidden wipers.

13 Claims, 6 Drawing Sheets

SUBSURFACE WELLBORE WIPER DEPLOYMENT SYSTEM AND METHOD OF USE

BACKGROUND

1. Field of the Invention

The present invention relates generally to well separating fluids and wiping the inside of a casing string in a conventional wellbore, and more specifically to a system and method that utilizes a plug with one or more exposed wipers and one or more hidden wipers to provide for an effective and efficient well casing wiping system.

2. Description of Related Art

Well drilling systems are well known in the art and are effective means to collect resources for energy use. During well drilling operations, a process of wiping in the inside of the casing string is common. This procedure is necessary for the removal of debris and contamination inside the casing to maintain predictable and optimal performance within the casing. Failure to properly and efficiently remove debris and contamination can result in costly cleanout operations, and accordingly there lies a need for improved wiping techniques, systems, and methods.

It is desirable, and an object of the present invention, to provide a system and method with an improved plug having one or more exposed wipers for a first level of wiping inside the casing string, and the plug having one or more hidden wipers that are deployed within the casing string at a predetermined location for providing fresh wipers for additional casing wiping.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
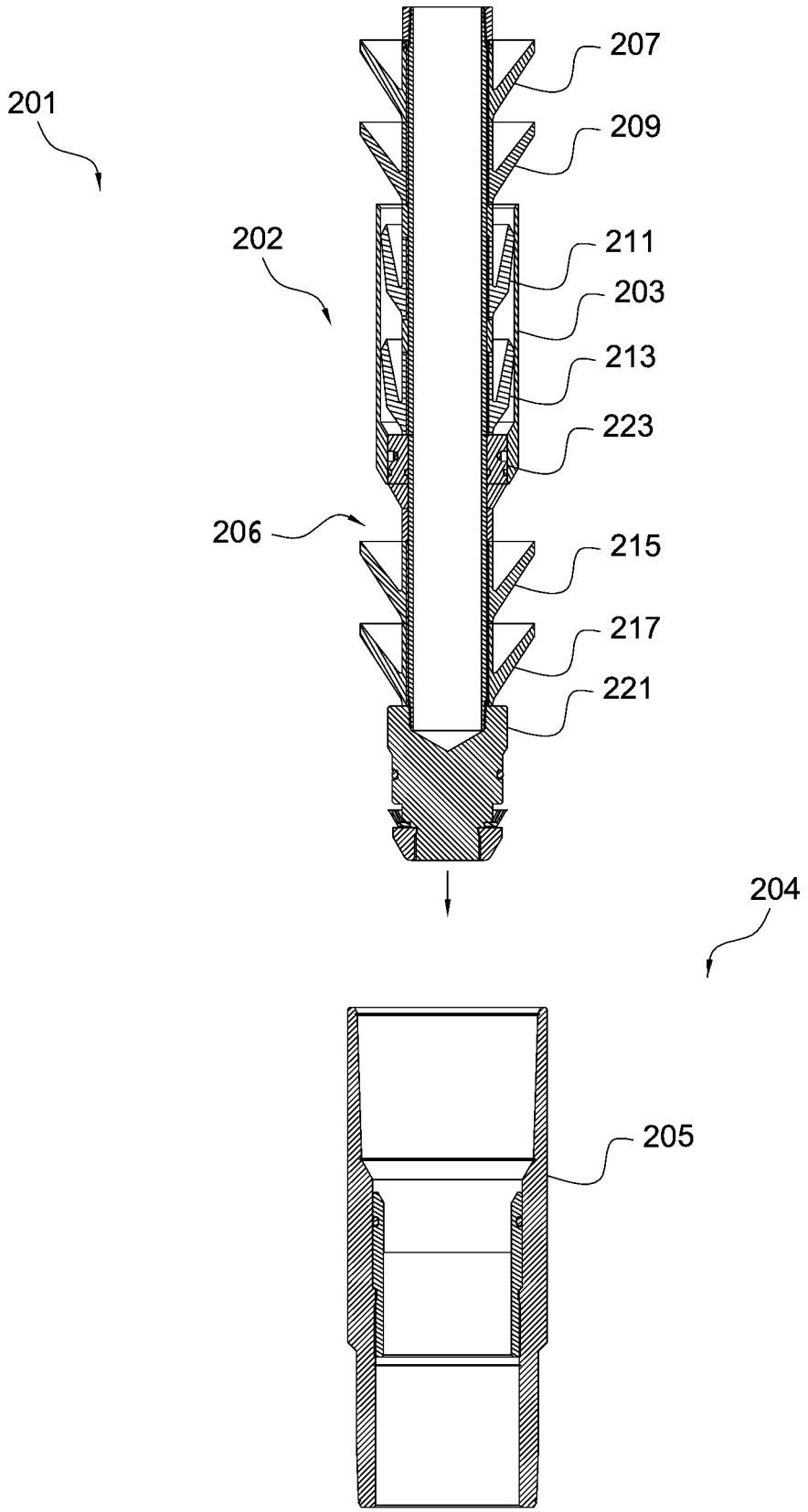
FIG. 1 is a side, cross sectional view of a subsurface wellbore wiper deployment system in accordance with a preferred embodiment of the present application shown in a first stage.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional casing wiper systems. Specifically, the present invention provides a system and method that includes subsurface wiper deployment for improved casing wiping. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
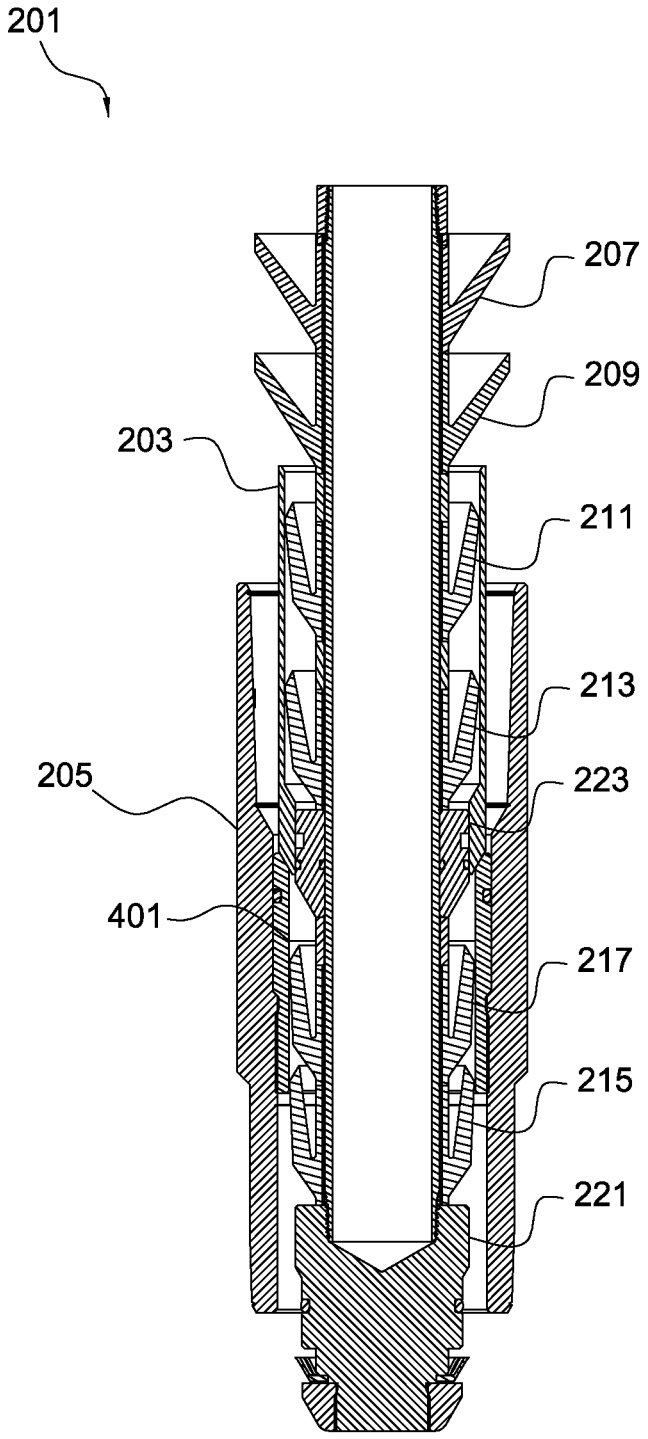
FIG. 2 is a side, cross sectional view of the system of FIG. 1 in a second stage.
Figure 3:
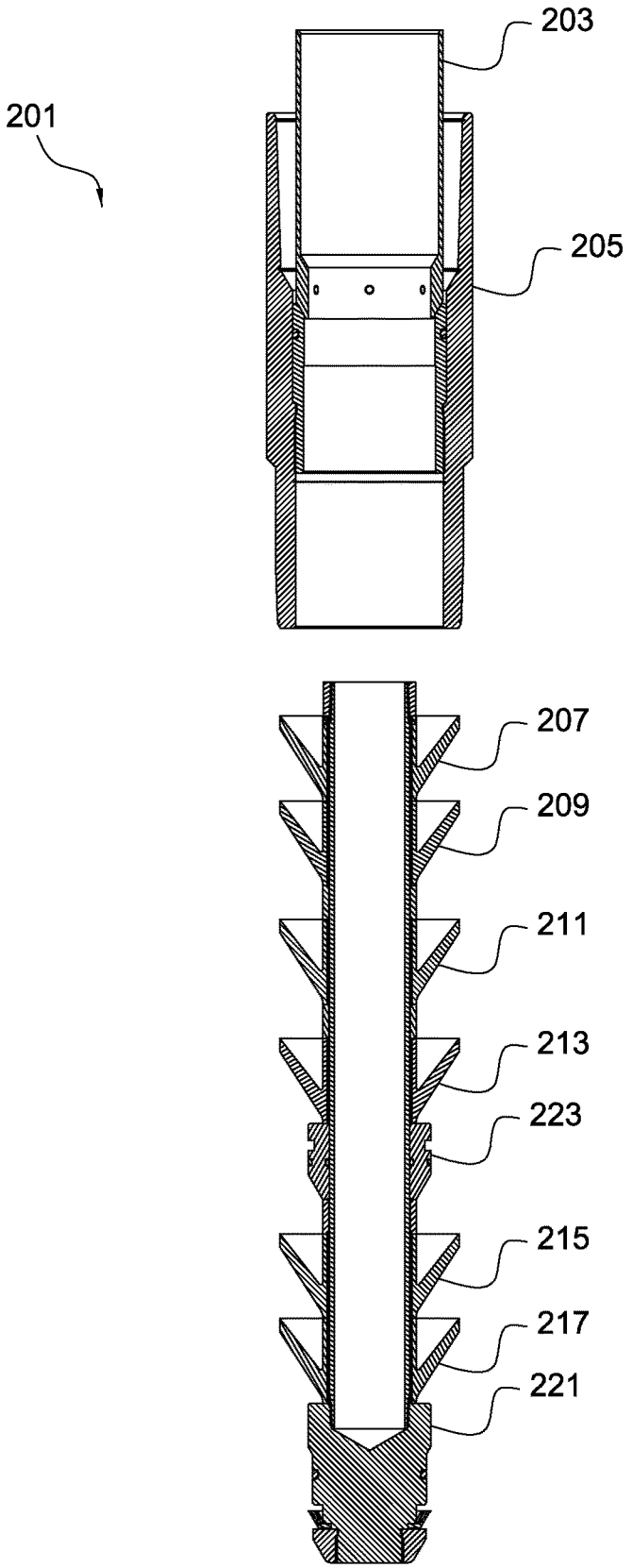
FIG. 3 is a side, cross sectional view of the system of FIG. 1 in a third stage.

Referring now to the drawings wherein like reference characters identify corresponding or similar elements throughout the several views, FIGS. 1-3 depict a series of side cross sectional views of a subsurface wellbore wiper deployment system 201 in accordance with a preferred embodiment of the present application. It should be appreciated that the system of the present invention provides for improved well casing wiping and fluid separation by including subsurface wiper deployment.

In the preferred embodiment, system 201 includes a plug 202 having a removable sleeve 203 secured over one or more hidden wipers 211, 213 and further including one or more exposed wipers 207, 209, 215, 217. In one embodiment, the exposed wipers include a first pair 207, 209 positioned above the removable sleeve 203 and a second pair 215, 217 positioned below the removable sleeve 203. The plug 202 of the preferred embodiment includes a pair 211, 213 of hidden wipers. As shown, the plurality of wipers are attached to an exterior surface of the plug 202 elongated body 206, such that the plurality of wipers extend away from the exterior surface and are configured to come into contact with an interior surface of the casing string when deployed.

The plug 202 can vary in other features and includes a nose 221 positioned at a leading end of the body 206. It should be appreciated that the plug can be altered as functional considerations require as would be known to those skilled in the art.

Figure 5:
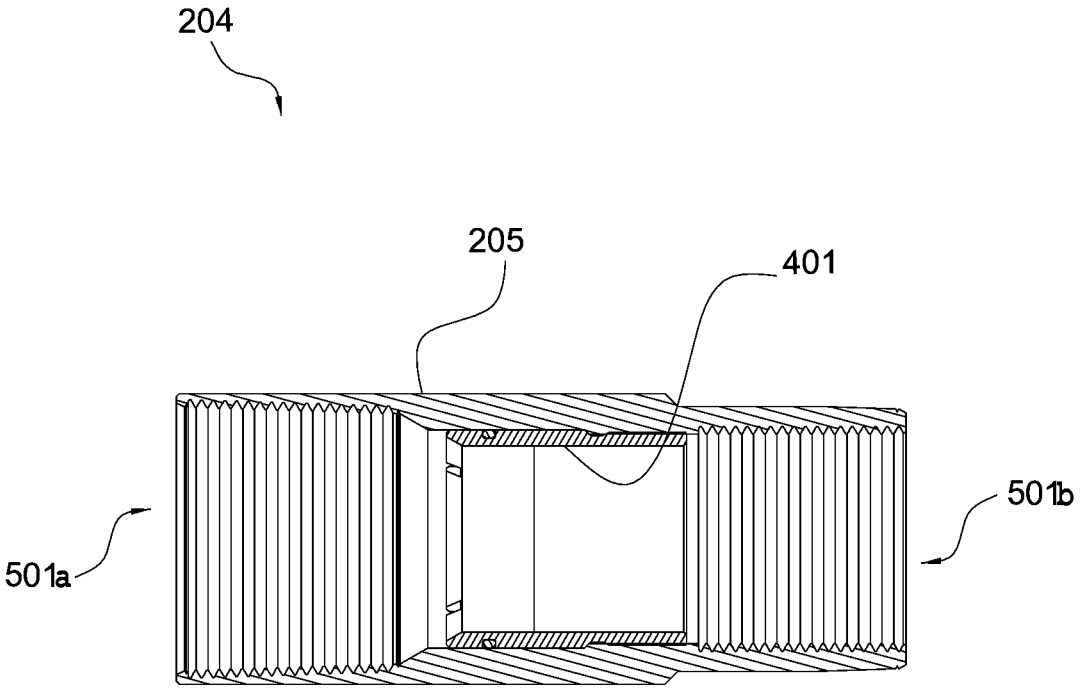
FIG. 5 is a side, cross sectional view of a landing collar of FIG. 1.

System 201 further includes a landing collar 204 with a body 205 and having a landing seat 401 and a channel extending through the collar 204 (shown in FIG. 5). The collar 204 includes one or more threaded connections 501*a-b* configured to engage with and remain permanently attached to the casing string of the wellbore operation.

As shown in FIGS. 1-3, the landing collar 204 will be secured along the casing string at a mid-point. The plug 202 will be deployed from the surface such that the exposed one or more wipers will be used to remove debris and contamination from the interior of the casing string upon contact. The plug 202 will enter the landing collar 204 at the position of the landing collar within the casing string, shown in FIG. 2. The landing seat 401 engages with the removable sleeve 203 such that differential pressure is applied to the plug and causes the removable sleeve to separate from the plug, shown in FIG. 3. The one or more hidden wipers 211, 213 are now exposed for fresh wiping of the casing string.

It should be appreciated that the removable sleeve 203 is removably secured in place via a cover attachment ring 223 that is attached to and extends around a periphery of the elongated body 206. In the preferred embodiment, both the removable sleeve and the landing seat are dissolvable. This feature is important, as it provides a means for the sleeve and seat to dissolve within the wellbore as opposed to requiring drill out operations. The landing collar 204 will remain as an integral component of the casing string during operations.

It should be appreciated that one of the unique features believed characteristic of the present invention is the use of a removable sleeve to cover the one or more hidden wipers to allow for subsurface deployment of the one or more hidden wipers. This allows for the hidden wipers to be protected from wear during initial displacement, which leads to improved wiping and fluid separation moving forward within the casing string.

Figure 4:
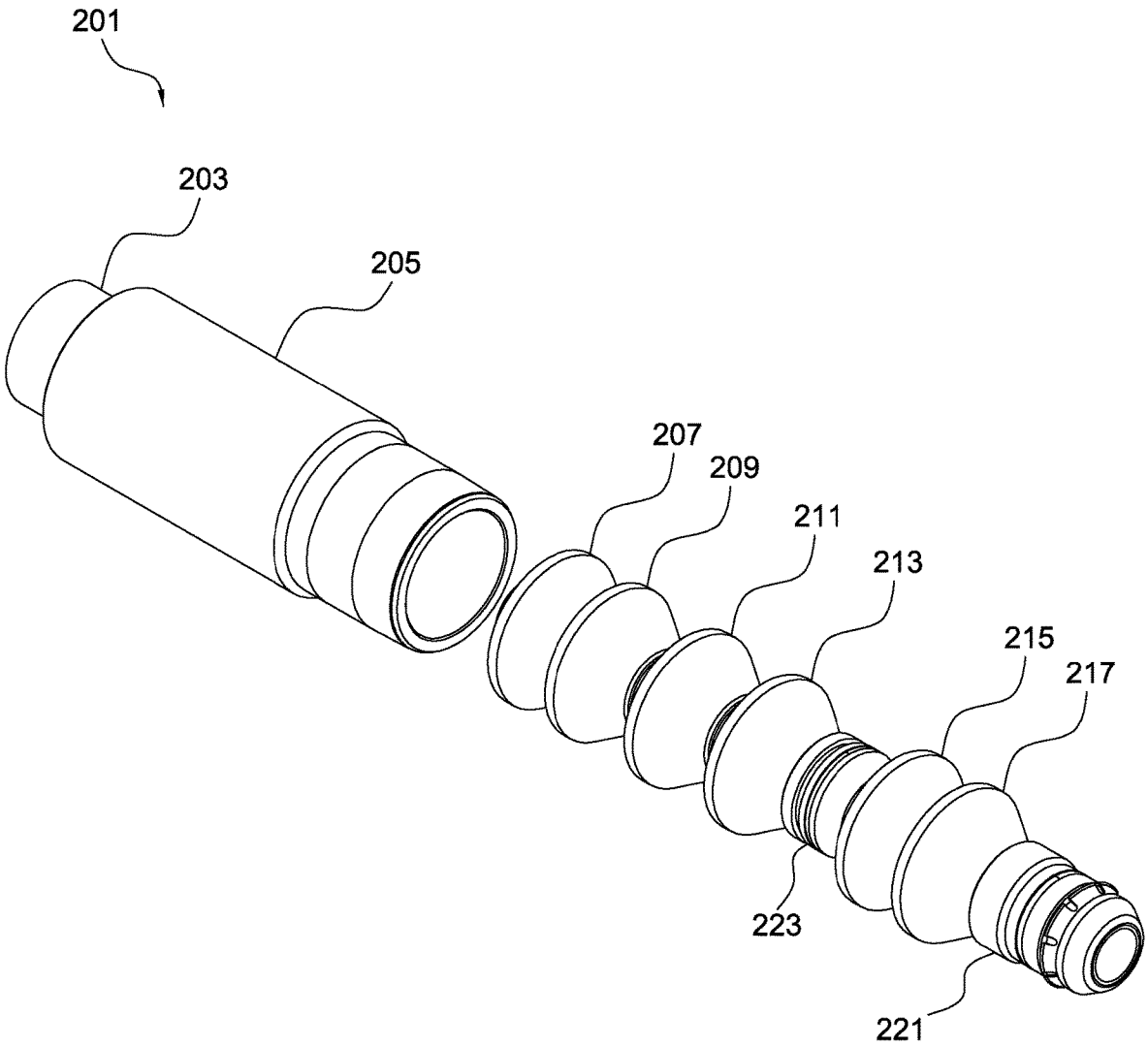
FIG. 4 is an isometric view of the system of FIG. 1.

In FIG. 4, an isometric view of system 201 is shown for clarity. In this view, the removable sleeve has been removed to expose the hidden wipers. Again, it must be appreciated and understood that the precise form of the system can vary for functional considerations.

Figure 6:
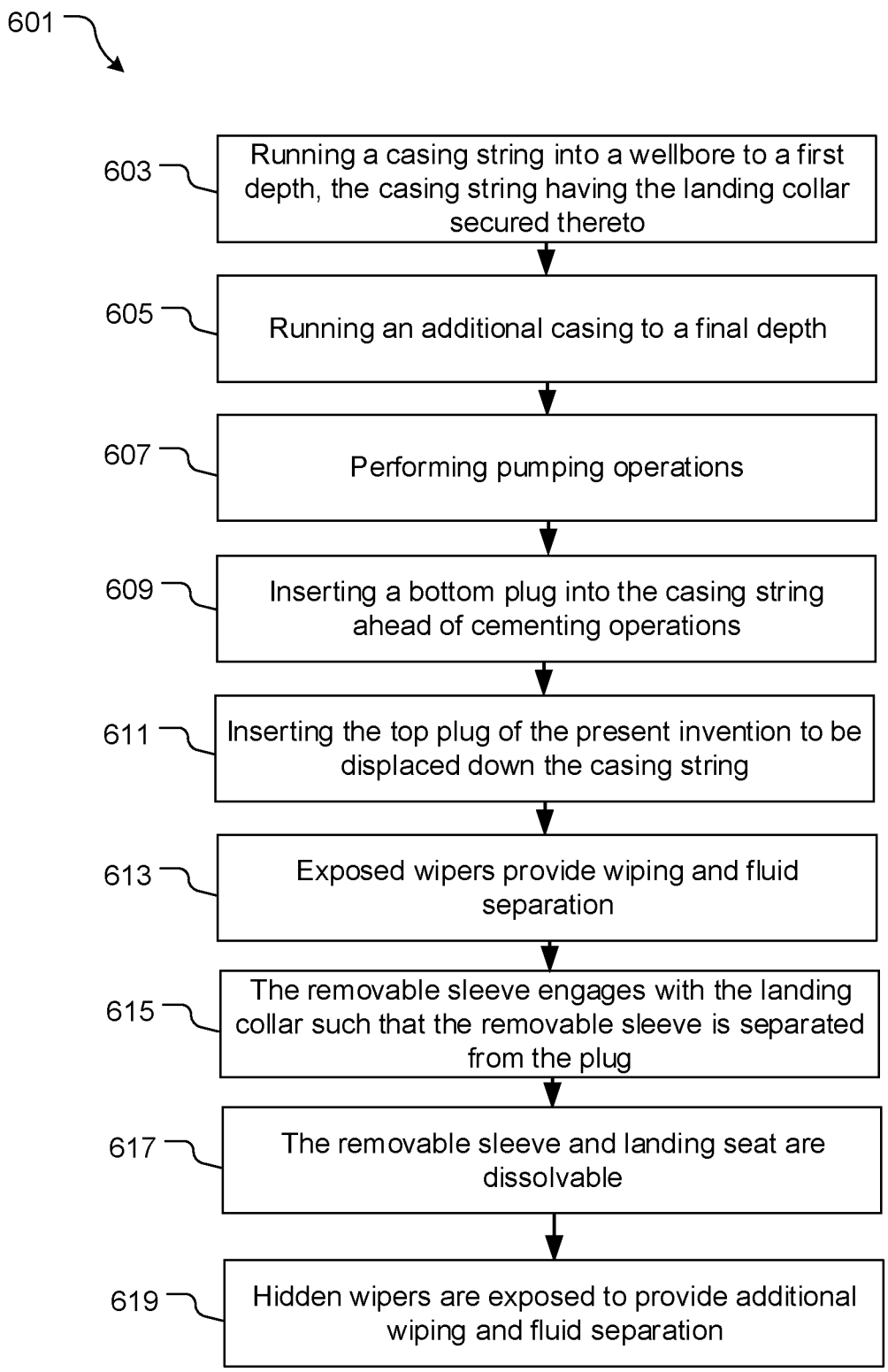
FIG. 6 is a flowchart of a method of use of the system of FIG. 1.

In FIG. 6, a flowchart 601 depicts the method of use of system 201. During use, the casing string is run into the wellbore to a first depth, the casing string having the landing collar secured thereto, as shown with box 603. An additional casing is run to a final depth past the landing collar, as shown with box 605. Conditioning operations can then be performed in preparation for cementing operations within the wellbore, as shown with box 607. If needed, a first plug is inserted into the casing string ahead of the cement and then the plug of the present invention, with exposed and hidden wipers, is inserted and displaced down the casing string, as shown with boxes 609, 611. During initial deployment of the plug, the exposed wipers provide interior casing string wiping and fluid separation, as shown with box 613. During the deployment, the plug engages with the landing collar such that the removable sleeve engages with the landing seat and as differential pressure is applied to the plug, the removable sleeve disengages with the landing collar, as shown with box 615. In the preferred embodiment, the removable sleeve and landing seat are dissolved and dissolve within the wellbore such that they do not have to be drilled out, as shown with box 617. After the removable sleeve is disengaged from the plug, the hidden wipers are exposed and provide for additional wiping of the interior of the casing, as shown with box 619.

It should be appreciated that some of the benefits provide by the system and method of the present invention include: (1) the landing collar includes a large inner diameter compared to the casing inner diameter, thereby providing a non-invasive channel that does not impact fluid circulation operations prior to cementing; (2) the system does not introduce any restriction that adversely affects the operations; (3) the system provides for subsurface deployment of fresh, new wipers deep within the lateral section of the wellbore, where conventional surface launched plug performance would begin to be affected because of wear caused by displacement to that depth of the well; (4) the dissolvable materials used in the production of the landing seat and the removable sleeve eliminates the need for drill out operations prior to performing stimulation operations; (5) the dissolvable materials can be tailored to have a dissolution rate that meets operational requirements of the specific job at hand; and (6) deployment of hidden wipers is not limited to one depth, but rather a plurality of landing collars and hidden wipers with sleeves, can be incorporated into the system to provide one or more depths where hidden wipers can be exposed, thus providing additional wiping improvement at multiple depths in the casing.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A subsurface wellbore wiper deployment system, comprising:
   - a plug having:
     - an elongated body with an exterior surface;
     - one or more exposed wipers extending away from the exterior surface; and
     - one or more hidden wipers secured to the exterior surface and positioned underneath a removable sleeve; and
   - a landing collar having a landing seat extending into an interior of the landing collar;
   - wherein the removable sleeve is configured to engage with the landing seat upon deployment of the plug; and
   - wherein the landing collar removes the removable sleeve to expose the one or more hidden wipers.

2. The system of claim 1, wherein the one or more exposed wipers comprises a first pair positioned below the sleeve and a second pair positioned above the sleeve.

3. The system of claim 1, wherein the one or more hidden wipers comprises a pair of hidden wipers.

4. The system of claim 1, wherein the landing seat is dissolvable.

5. The system of claim 1, wherein the plug further comprises a nose at a leading end of the elongated body.

6. The system of claim 1, wherein the removable sleeve is dissolvable.

7. The system of claim 1, wherein the plug further comprises:

an attachment ring secured around a periphery of the plug;

wherein the attachment ring is configured to engage with the sleeve to cover the one or more hidden wipers.

8. A subsurface wellbore wiper method, the method comprising:

securing a landing collar with a landing seat at a location along a casing string;

providing a plug having an elongated body with one or more exposed wipers and one or more hidden wipers extending from an exterior surface of the elongated body, the one or more hidden wipers being covered by a removable sleeve;

performing conditioning operations within the wellbore;

inserting the plug into the casing string to be displaced down the casing string;

wherein the one or more exposed wipers of the plug provide a wiper function within the wellbore string; and wherein the plug travels through the landing collar such that the removable sleeve engages with the landing seat and separation of the removable sleeve occurs via differential pressure.

9. The method of claim 8, further comprising:

inserting a bottom plug into the casing string prior to cementing operations.

10. The method of claim 8, wherein the landing seat and removable sleeve are dissolvable.

11. The method of claim 8, wherein the plug further comprises:

an attachment ring secured around a periphery of the plug;

wherein the attachment ring is configured to engage with the sleeve to cover the one or more hidden wipers.

12. The method of claim 8, wherein the one or more exposed wipers comprises a first pair positioned below the removable sleeve and a second pair positioned above the removable sleeve.

13. The method of claim 8, wherein the one or more hidden wipers comprises a pair of hidden wipers.

* * * * *